US008136700B2

(12) United States Patent
LaFlamme et al.

(10) Patent No.: US 8,136,700 B2
(45) Date of Patent: Mar. 20, 2012

(54) DUAL CHAMBERED FLUID DISPENSER WITH MIXING CHAMBER

(75) Inventors: Roger J. LaFlamme, Enfield, CT (US); Jim F. Warner, Westfield, NJ (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 952 days.

(21) Appl. No.: 12/035,569

(22) Filed: Feb. 22, 2008

(65) Prior Publication Data

US 2008/0203110 A1 Aug. 28, 2008

Related U.S. Application Data

(60) Provisional application No. 60/891,312, filed on Feb. 23, 2007.

(51) Int. Cl.
*B67D 7/70* (2010.01)

(52) U.S. Cl. ..... 222/135; 222/94

(58) Field of Classification Search ..... 222/133–135, 222/94–96, 102, 106, 213, 214, 207, 145.4
See application file for complete search history.

(56) References Cited

U.S. PATENT DOCUMENTS

| | | | | |
|---|---|---|---|---|
| 886,984 | A | 5/1908 | Jopling | |
| 1,217,054 | A | 2/1917 | Pearman | |
| 1,941,745 | A | 1/1934 | Higley | |
| 2,714,475 | A | 8/1955 | Roehrich | |
| 2,819,723 | A * | 1/1958 | Meyer | 132/116 |
| 2,855,127 | A | 10/1958 | Lerner et al. | |
| 3,223,289 | A | 12/1965 | Bouet | |
| 3,396,419 | A | 8/1968 | Richter et al. | |
| 3,617,139 | A | 11/1971 | Ross | |
| 3,949,137 | A | 4/1976 | Akrongold et al. | |
| 3,981,106 | A | 9/1976 | Gallo | |
| 4,004,854 | A | 1/1977 | Breer, II | |
| 4,040,420 | A * | 8/1977 | Speer | 604/82 |
| 4,074,944 | A | 2/1978 | Xavier | |
| 4,098,434 | A | 7/1978 | Uhlig | |
| 4,124,316 | A | 11/1978 | O'Rourke | |
| 4,127,515 | A | 11/1978 | MacRae et al. | |
| 4,188,989 | A | 2/1980 | Andersen | |
| 4,687,663 | A * | 8/1987 | Schaeffer | 424/52 |

(Continued)

FOREIGN PATENT DOCUMENTS

DE 4030851 4/1992

(Continued)

OTHER PUBLICATIONS

Stephen & Lawyer, Inc., Reticulated Foam, http://www.steplaw.com/reticulatedfoam.html.

(Continued)

*Primary Examiner* — Lien Ngo
(74) *Attorney, Agent, or Firm* — St. Onge Steward Johnston & Reens LLC

(57) ABSTRACT

A dispensing device is provided that includes at least two separate reservoirs therein and a dispenser for mixing and delivering a substantially equal metered dose of fluid material from the reservoirs with each dispensing operation. In one example, the present invention relates to a dispenser for mixing and delivering hair colorant that allows the user to dispense a metered dose of the hair colorant components in a manner that measures and mixes those components with each dispensing operation. An optional applicator may be provided for even distribution of the dispensed hair colorant material.

19 Claims, 6 Drawing Sheets

U.S. PATENT DOCUMENTS

| | | | | |
|---|---|---|---|---|
| 4,702,397 | A | 10/1987 | Gortz | |
| 4,753,006 | A | 6/1988 | Howe | |
| 4,760,642 | A | 8/1988 | Kwak | |
| 4,809,432 | A | 3/1989 | Schauble | |
| 4,871,090 | A * | 10/1989 | Hoffmann | 222/81 |
| 4,886,388 | A | 12/1989 | Gulker et al. | |
| 4,888,868 | A | 12/1989 | Pritchard | |
| 4,889,441 | A | 12/1989 | Tice | |
| 4,890,744 | A | 1/1990 | Lane, Jr. et al. | |
| 4,993,594 | A | 2/1991 | Becker et al. | |
| 5,014,427 | A | 5/1991 | Byrne | |
| 5,016,351 | A | 5/1991 | Drahus | |
| 5,074,765 | A | 12/1991 | Pekar | |
| 5,114,255 | A | 5/1992 | Villarreal | |
| 5,152,432 | A * | 10/1992 | De Laforcade | 222/145.1 |
| 5,168,628 | A | 12/1992 | Mock et al. | |
| 5,176,510 | A | 1/1993 | Nilsson | |
| 5,249,709 | A * | 10/1993 | Duckworth et al. | 222/137 |
| 5,261,570 | A | 11/1993 | Hippely et al. | |
| 5,265,772 | A | 11/1993 | Bartasevich et al. | |
| 5,303,851 | A | 4/1994 | Libit et al. | |
| 5,337,478 | A | 8/1994 | Cohen et al. | |
| 5,353,961 | A | 10/1994 | Debush | |
| 5,356,039 | A | 10/1994 | Christine et al. | |
| 5,372,487 | A | 12/1994 | Pekar | |
| 5,387,207 | A | 2/1995 | Dyer et al. | |
| 5,441,345 | A | 8/1995 | Garvey et al. | |
| 5,482,980 | A | 1/1996 | Pcolinsky | |
| 5,505,341 | A | 4/1996 | Gueret | |
| 5,555,673 | A | 9/1996 | Smith | |
| 5,564,190 | A | 10/1996 | Fleetwood | |
| 5,640,737 | A | 6/1997 | Boggs | |
| 5,700,245 | A | 12/1997 | Sancoff et al. | |
| 5,701,674 | A | 12/1997 | Mitchell | |
| 5,704,723 | A | 1/1998 | Salisian | |
| 5,761,813 | A | 6/1998 | Frick et al. | |
| 5,836,482 | A | 11/1998 | Ophardt et al. | |
| 5,842,607 | A | 12/1998 | Snider | |
| 5,848,730 | A * | 12/1998 | Kawase et al. | 222/94 |
| 5,855,066 | A | 1/1999 | Manager | |
| 5,865,554 | A | 2/1999 | Lin | |
| 5,934,296 | A | 8/1999 | Clay | |
| 5,944,032 | A | 8/1999 | Masterson | |
| 5,950,928 | A | 9/1999 | Giang et al. | |
| 5,983,500 | A | 11/1999 | da Silva | |
| 6,183,154 | B1 | 2/2001 | Coe | |
| 6,210,064 | B1 | 4/2001 | White et al. | |
| 6,251,098 | B1 | 6/2001 | Rake et al. | |
| 6,302,607 | B1 | 10/2001 | Burrowes et al. | |
| 6,394,316 | B1 | 5/2002 | Daansen | |
| 6,406,207 | B1 | 6/2002 | Wiegner et al. | |
| 6,419,118 | B1 | 7/2002 | Rees et al. | |
| 6,454,135 | B1 * | 9/2002 | Brozell | 222/135 |
| 6,558,629 | B1 | 5/2003 | Davidson | |
| 6,623,201 | B2 | 9/2003 | Brumlik | |
| 6,629,799 | B2 | 10/2003 | Flores, Jr. | |
| 6,641,307 | B2 | 11/2003 | Matsuda et al. | |
| 6,715,952 | B1 | 4/2004 | Aiken et al. | |
| 6,754,958 | B2 | 6/2004 | Haws et al. | |
| 6,789,321 | B2 | 9/2004 | Simms | |
| 6,789,706 | B2 | 9/2004 | Abergel et al. | |
| 6,843,368 | B1 | 1/2005 | Frutin | |
| 6,883,563 | B2 | 4/2005 | Smith | |
| 6,886,254 | B1 | 5/2005 | Pennella | |
| 6,910,274 | B1 | 6/2005 | Pennella et al. | |
| 6,925,716 | B2 | 8/2005 | Bressler et al. | |
| 6,929,155 | B1 | 8/2005 | Sayers | |
| 6,964,097 | B2 | 11/2005 | Franzini et al. | |
| 6,996,908 | B2 | 2/2006 | Orloff et al. | |
| 7,043,841 | B2 | 5/2006 | Franzini et al. | |
| 7,121,754 | B2 | 10/2006 | Bressler et al. | |
| 7,137,203 | B2 | 11/2006 | Bressler et al. | |
| 7,137,531 | B2 | 11/2006 | Arghyris et al. | |
| 7,156,132 | B2 | 1/2007 | O'Dougherty et al. | |
| 7,159,742 | B2 | 1/2007 | Lee | |
| 7,481,334 | B2 * | 1/2009 | Arghyris et al. | 222/137 |
| 2001/0025859 | A1 | 10/2001 | Dumont | |
| 2001/0025860 | A1 | 10/2001 | Auer | |
| 2002/0085873 | A1 | 7/2002 | Katsandres et al. | |
| 2003/0077106 | A1 | 4/2003 | Weihrauch | |
| 2003/0121936 | A1 | 7/2003 | De Laforcade | |
| 2004/0092864 | A1 | 5/2004 | Boehm, Jr. et al. | |
| 2004/0140326 | A1 | 7/2004 | Smart et al. | |
| 2004/0177510 | A1 | 9/2004 | Pennella | |
| 2004/0178284 | A1 | 9/2004 | Fahy et al. | |
| 2005/0138814 | A1 | 6/2005 | Pennella et al. | |
| 2005/0144785 | A1 | 7/2005 | Bressler et al. | |
| 2005/0199651 | A1 | 9/2005 | Laflamme et al. | |
| 2006/0072858 | A1 | 4/2006 | Kurosawa et al. | |
| 2006/0150386 | A1 | 7/2006 | Wanli et al. | |
| 2006/0163282 | A1 * | 7/2006 | Suzuki | 222/135 |
| 2006/0249536 | A1 * | 11/2006 | Hartman et al. | 222/129.3 |
| 2006/0254056 | A1 | 11/2006 | Coffin et al. | |
| 2006/0255068 | A1 * | 11/2006 | Genosar | 222/207 |
| 2006/0272154 | A1 | 12/2006 | Brevard | |
| 2007/0017098 | A1 | 1/2007 | Bressler et al. | |
| 2007/0068966 | A1 * | 3/2007 | Orzech et al. | 222/136 |
| 2007/0084058 | A1 | 4/2007 | Szczepanowski et al. | |
| 2007/0214646 | A1 | 9/2007 | Bezdek | |

FOREIGN PATENT DOCUMENTS

| | | | |
|---|---|---|---|
| DE | 29719331 | | 12/1997 |
| DE | 29818058 | | 1/1999 |
| FR | 2628394 | A1 | 9/1989 |
| FR | 2683759 | | 11/1991 |
| GB | 2083142 | A | 3/1982 |
| JP | 6293348 | | 10/1994 |
| JP | 10165668 | | 6/1998 |
| JP | 2005199020 | | 7/2005 |
| WO | 0176972 | A1 | 10/2001 |
| WO | 0176974 | A1 | 10/2001 |
| WO | 02071907 | A1 | 9/2002 |
| WO | 2004096504 | | 7/2003 |
| WO | 2005086852 | A2 | 9/2005 |

OTHER PUBLICATIONS

3M Worldwide, Scotch-Brite Urethane Laminate 325HK 5 Pieces/Pack 72 Packs/Case, http://products3.3m.com/catalog/hk/en009/home_leisure/-/node_H16XQM6PDVgs/root_B....

Plastic Bags For You, Pouch (zipper & non zipper), flat pouch, stand up pouch, with and without valve, with and without window, plain & preprinted, paper bag, etc., http://plasticbagsforyou.com/PRODUCTS/pouch-group.html.

* cited by examiner

DUAL CHAMBERED FLUID DISPENSER WITH MIXING CHAMBER

CROSS-REFERENCE TO RELATED APPLICATIONS

This application is related to and claims priority from earlier filed U.S. Provisional Patent Application No. 60/891,312 filed Feb. 23, 2007.

BACKGROUND OF THE INVENTION

The present invention relates generally to product packaging and/or containers that include integrated dispensing devices. More specifically, the present invention relates to a multiple reservoir fluid container that allows the user to introduce a metered amount of fluid from each of the reservoirs into a mixing chamber that serves to mix and apply the fluid material.

Various types of fluid material and media are employed for different purposes throughout commerce and industry. For example, there are various products in the areas of personal care, home care, air care, transportation care and food industries that require a fluid material to be dispensed in some manner from a source of such material. Further, when this material is sold in commerce, it must be contained and stored in some type of container while awaiting use. Ultimately, when that product is used, it must be dispensed from its storage container to the desired location for use.

In the prior art, there are many different types of dispensers that are employed for the delivery of a stored fluid material to their desired location for use. For example, a storage container having a flexible body with a nozzle tip extending therefrom is commonly provided for such a purpose. An example of such use can be seen in the context of a ketchup dispenser, where a user squeezes the container body to urge the fluid material (ketchup) out from container body and through the nozzle tip to accurately deposit the fluid material at the desired location. In such an application, the amount of fluid that is ultimately delivered is determined by the how much the user actually squeezes the container body. While this method has provided marginally acceptable results, this method also typically yields an erratic fluid volume since more or less fluid material may be delivered on each successive squeeze of the container body. Also, the container must be held upright to avoid leakage because no valves are employed in the fluid nozzle tip.

In another example of a prior art dispensing device, a flexible container is provided that holds a volume of fluid material to be delivered. In an attempt to overcome the leakage issue noted above, a single one-way check valve is provided at the exit port of the flexible container. When the flexible body is squeezed, the material is urged out under pressure through the valve. The difficulty here is that the valve over time becomes partially clogged thereby requiring that the user apply additional pressure to cause the valve to open. As a result, once the valve opens, the additional pressure causes more fluid material to be deposited than the user typically would have desired.

In addition to the above noted need for simply dispensing a volume of fluid material onto an available surface, there has also been a desire to help in applying them as they are dispensed, such as to a surface. In the prior art, to meet this need, the squeezable container bodies have been equipped with some type of applicator head. For example, in the personal care industry, body wash devices commonly include some type of squeezable container body and an applicator material, such as fabric or foam, applied to an outer surface thereof. In this arrangement, when the fluid material is dispensed to the exterior of the container body, it enters the applicator material and the applicator assists in spreading the fluid as desired. The use of such applicators thereby facilitates the spreading of the fluid within the applicator resulting in better and more even distribution thereof. Applicators are particularly useful for even distribution in fluids employed in the personal care industry, such as for shoe polish, hair colorant, conditioners, the like to ensure a quality even and smooth coat.

Still further, while an applicator enhances the application of dispensed fluid materials, there is a particular need for an effective device that can dispense a two component fluid material, such as for example, hair colorant. Hair colorant typically has two components, including a color and a dye, which need to be precisely mixed for good and consistent coloring results. Previously, a stylist carefully measured and dispensed the two components into a container where they were mixed and then applied to the customer's hair using a brush. There is a need for a device that can mix these two components and deliver them to a person's hair. While in the prior art, the concept of dual chambered product storage containers is not novel, the user typically had little control over the amount or rate at which the material in the two chambers was combined. In other words, in the prior art it is typically an all or nothing proposition when mixing the contents of the two chambers. In other words, the previously available prior art devices are incapable of delivering a substantially equal dose of fluid with each operation because they simply open up the container body and permit the combination of the two fluids that were previously maintained separately in the two chambers. In this context, such a lack of control is highly undesirable when a user is attempting to controllably mix products like hair colorants.

In view of the foregoing, there is need for a device that eliminates prior art dual chambered containers that suffer from various disadvantages detailed above that make them difficult and awkward to use. Further, because these prior art dispensers often provide a user with unexpected results, there is a need for a dual reservoir fluid container that includes a selective metering mechanism that is easy to operate. There is a further need for a dual fluid dispenser that operates in connection with at least two fluid reservoirs that is capable of delivering a metered amount of each of the fluids with each dispensing operation in order to produce predictable flow and a better control of the fluid material application. Many of these needs are met by commonly owned, co-pending U.S. patent application Ser. No. 11/074,817, filed on Mar. 8, 2005 and U.S. patent application Ser. No. 11/951,351, filed on Dec. 6, 2007, which are incorporated herein by reference. This application sets forth a device for dispensing accessory liquids from at least two reservoirs in a metered fashion into a mixing chamber that then dispenses the mixed fluids to an applicator.

BRIEF SUMMARY OF THE INVENTION

In this regard, the present invention preserves the advantages of prior art metering dispensing devices and dual reservoir fluid containers. In addition, the present invention provides new advantages not found in currently available devices and overcomes many disadvantages of such currently available devices.

The present invention is generally directed to a novel and unique fluid container that has at least two separate reservoirs therein and a dispenser for mixing and delivering a substantially equal metered dose of fluid material from the reservoirs with each dispensing operation. In one example, the present invention relates to a dispenser for mixing and delivering hair colorant that allows the user to dispense a metered dose of the hair colorant components in a manner that measures and mixes those components with each dispensing operation. Further, in another embodiment, the invention includes an optional applicator that is provided for even distribution of the dispensed hair colorant material. Still further, it should be appreciated that wile hair colorant is employed as an example herein, other fluids can be dispensed using the present invention, such as conditioner.

Generally, as will be described in detail below, the hair colorant dispenser of the present invention includes two bladders that respectively contain the two components of the hair colorant mixture. Preferably, each bladder includes a one-way valve that exits to a mixing chamber. The two buttons on the top of the device press into the bladders to urge the materials from their respective chambers into the mixing chamber. From the mixing chamber, the mixed materials exit from the comb-like applicator head, which may be made of foam, for delivery onto the user's hair. Preferably, the delivery of the two components is in parallel to a single mixing chamber. Alternatively, the first chamber, with the first component therein, can exit into the second chamber, with the second component therein, in a series flow arrangement where the exit of the second chamber includes the mixed materials for delivery directly to the user's hair.

The metering mechanism employed within the present invention is substantially similar to that found in the above noted U.S. patent application Ser. Nos. 11/074,817 and 11/951,351. The accessory reservoir is formed to include an interior fluid storage region therein. A metering housing, having a preferably flexible construction, is disposed in fluid communication with the fluid storage region and a first one-way valve is disposed between the container and the flexible metering housing. When the flexible metering housing is depressed and released a vacuum action generates a one-way flow from the interior fluid storage region of the container that serves to fill the predetermined volume of the chamber within the metering housing. A second valve, in fluid communication with the metering housing output port, permits one-way fluid flow from the metering chamber to the mixing chamber when the metering housing is depressed again. Each time the metering housing is depressed a substantially equal volume of fluid is dispensed from the reservoirs, while upon release, the metering housing is refilled by drawing fluid from the fluid storage bladders.

In view of the foregoing, a new and unique dispenser for a hair colorant is provided. The new dispenser facilitates the delivery of hair colorant by neatly mixing the components of the hair colorant mixture within the dispenser for controlled delivery of the mixture. It is therefore an object of the present invention to provide a fluid dispensing device that can transfer and mix a substantially equal volume of fluid additive from at least two fluid storage reservoirs with each dispensing operation. These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
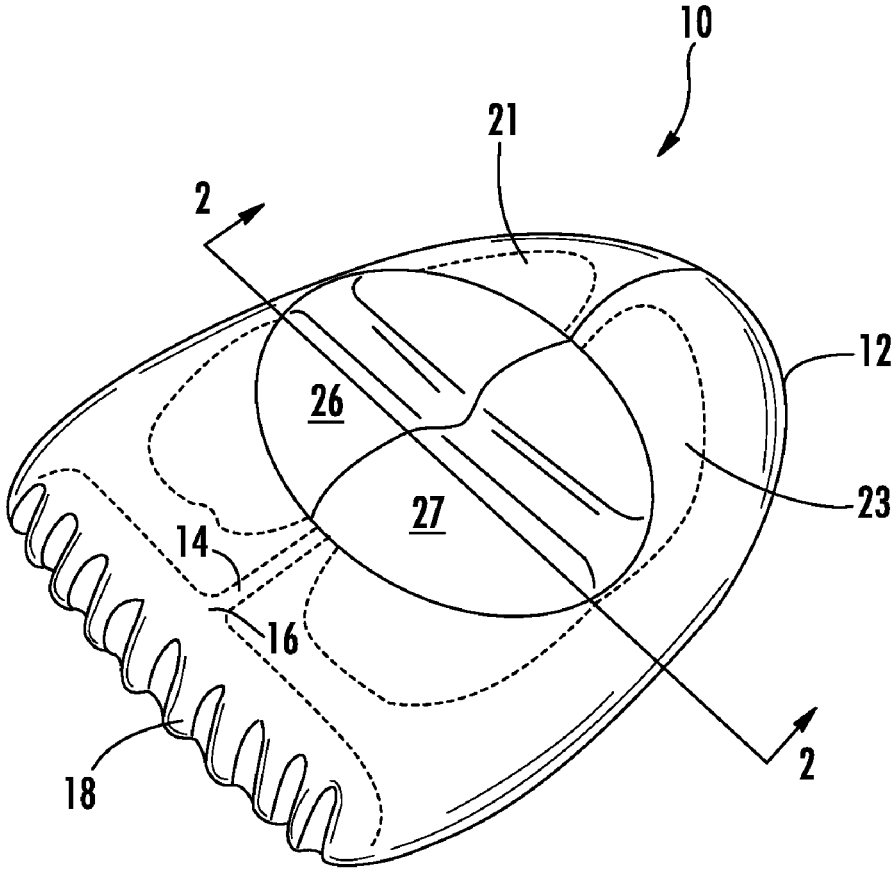
FIG. 1 is a perspective view of a dual reservoir dispensing device of the present invention.

Now referring to the drawings, a first embodiment of the dispensing device of the present invention is shown and generally illustrated at 10 in FIG. 1. As can be seen, the dispensing device 10 of the present invention has a main body 12 that is generally shown to include a first fluid reservoir 21 containing a first fluid 22, a second fluid reservoir 23 containing a second fluid 24. A first metered dosing pump 26 is provided in fluid communication with the first fluid reservoir 21 and is operable to transfer a portion of the first fluid 22 from the first fluid reservoir 21 to a mixing chamber 14. A second metered dosing pump 27 is provided in fluid communication with the second fluid reservoir 23 and is also operable to transfer a portion of the second fluid 24 from the second fluid reservoir 23 to the mixing chamber 14. In the mixing chamber 14, the first and second fluids 22, 24 are mixed and then dispensed from an exit aperture 16 for delivery to the user. The device 10 may also optionally include an applicator 18 in the form of a comb as depicted, a foam applicator or any other style applicator as is suitable for the application at hand. In the context of the present invention, this arrangement is suitable for use in connection with any application that requires two different fluids be stored separately prior to their use by the consumer, as in the case for example of, two-part epoxy adhesives, hair colorant systems or hair conditioning systems. While specific examples have been provided herein, they are meant for illustration and are not intended to be limiting on the scope of the present invention.

Figure 2:
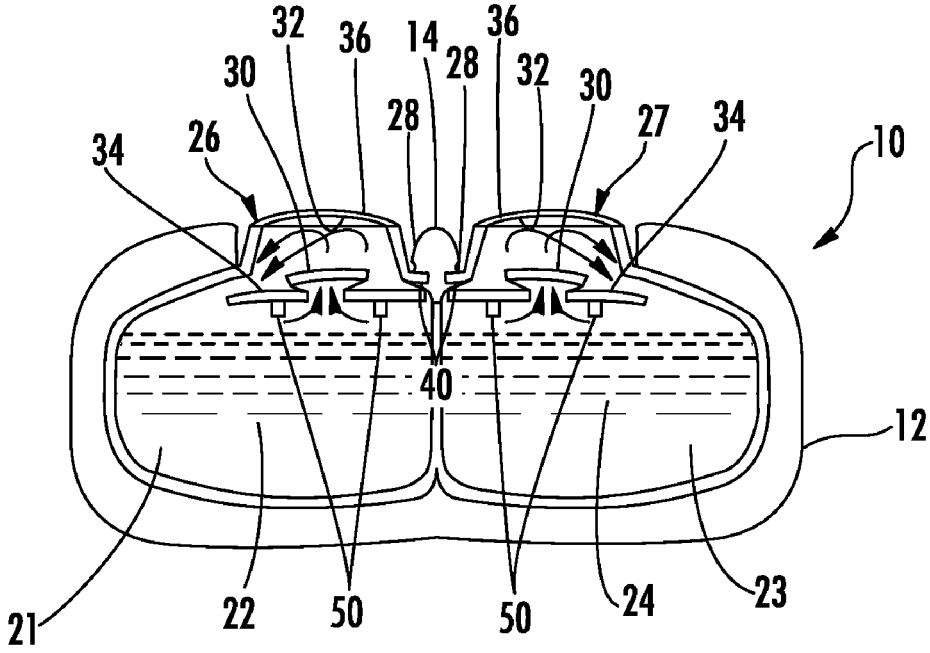
FIG. 2 is a cross sectional view of the dispensing device of the present invention taken along line 2-2 of FIG. 1.

Turning to FIGS. 1 and 2, the main body 12 can be seen to enclose the first and second fluid reservoirs 21, 23. The first fluid reservoir 21 has an outer wall that forms an interior cavity that serves as the first fluid reservoir 21 and contains a first fluid 22 therein. Similarly, the second fluid reservoir 23 also has an outer wall that forms an interior cavity that serves as the second fluid reservoir 23 and contains a second fluid 24 therein. A first metered dosing pump 26 is positioned in the first fluid reservoir 21 and is in fluid communication with the first fluid 22 contained therein. A second metered dosing pump 27 is positioned in the second fluid reservoir 23 and is in fluid communication with the second fluid 24 contained therein. The respective outputs 28 of the first and second fluid pumps 26, 27 in this embodiment are arranged in parallel to simultaneously deposit the first and second fluids 22, 24 into the mixing chamber 14.

FIG. 2 in particular depicts a cross-sectional view through the first and second metering pumps 26, 27 along the line 2-2 of FIG. 1 and is shown to illustrate the internal construction of the metering pumps 26, 27 used in connection with the fluid dispenser 10 of the present invention. The first and second metering pumps 26, 27 are constructed identically and therefore the matching features will be called out with matching reference numerals. As was stated above, the first and second fluid reservoirs 21, 23 are provided to include first and second fluid storage regions that each contains a volume of first and second fluid material 22, 24 respectively therein. The outer walls of the first and second fluid reservoirs 21, 23 are preferably made of a flexible material, such as plastic or nylon. Thus, as the first and second fluid material 22, 24 is evacuated from within the first and second fluid reservoirs 21, 23, they will collapse gradually for a compact structure.

Metering housings are provided at the first and second metering pumps 26, 27. The metering housings include an intake one-way valve 30, such as a check valve, to pull fluid 22, 24 from the fluid storage regions into a metering chamber 32 of a predetermined size. Any type of valve can be used to suit the given application. The intake valve 30 is positioned in a base plate 34 of the metering housing. Thus, fluid 22, 24 can only flow in one way from the fluid storage regions 21, 23 into the metering chamber 32. The metering chamber 32 is defined by a flexible membrane 36 in the form of a button or bulb that is accessible and manipulateable on the exterior surface of the outer housing 12 of the device 10. The button 36 is preferably clear to provide an indicator to the consumer when the metered dosage of fluid material 22, 24 is ready for delivery. Further, it is preferred that the two metering pumps 26, 27 are positioned adjacent one another so that the user can press both metering pumps 26, 27 simultaneously.

An output valve 40 is provided in fluid communication with the metering chamber 32 of the metering housing. Thus, the fluid residing in the metering chamber 32 can only exit through the output valve 40 into the mixing chamber 14 that serves to direct the exit of the fluids 22, 24. In this particular case to the interior of the mixing chamber 14.

In accordance with the present invention, each press of the flexible membrane 36 causes a metered amount of first and second fluid 22, 24 to be forced into the mixing chamber 14. It should be appreciated that the button/membrane 36 can be placed anywhere on the device 10, as needed. Still referring to FIG. 2, the operation of the metered dosing pumps 26, 27 are further explained. The button 36 of the metering housing is depressed to initiate a vacuum operation. More specifically, when the button 36 is further released, first and second fluid 22, 24 is pulled from the first and second fluid reservoirs 21, 23 into the metering chamber 32 which is configured to be of a certain known volume. The act of releasing the button 36 fills the metering chamber 32 to substantial capacity. Thus, a metered amount of fluid material 22, 24 is contained within the metering chamber 32 in preparation for delivery. The size of the metering chamber 32 can be selected according to the type of fluid material 22, 24 to be dispensed, the application therefor and the desired dosage volume. The volumes may be matched or different as required by the particular application at hand. A further depression of the button 36 urges the measured volume of fluid 22, 24 within the metering chamber 32 to exit out through the mixing chamber 14 of the metering housing. This known amount of fluid material 22, 24 is then routed into the mixing chamber 14. This allows in most cases for the first and second fluids 22, 24 to be mixed before dispensing. In the case of a hair colorant system for example, dye and the colorant are deposited directly into the mixing chamber 14 and thoroughly mixed before dispensing preferably into an applicator 18. The mixed fluids are then ready for application to a user's hair via the applicator 18.

It can also be seen in FIG. 2 that a number of standoff legs 50 emanate downwardly from the base plate 34 of the metering housing. These legs 50 prevent the base plate 34 from completely bottoming out against the fluid reservoir 21, 23 wall thereby blocking flow of fluid material 22, 24 into the intake valve 30. The standoff legs 50 are particularly useful when the volume of fluid material 22, 24 left in the fluid reservoir 21, 23 is running low and the fluid reservoir 21, 23 is becoming relative flat in configuration. In this situation, there is a possibility that the aforesaid bottoming out may occur. However, the use of the standoff legs 50 prevents this from occurring. It should also be appreciated that while standoff legs 50 are shown, other spring biased or spring like structures may be used to accomplish the same function and should be considered interchangeable with the standoff legs 50.

Figure 3:
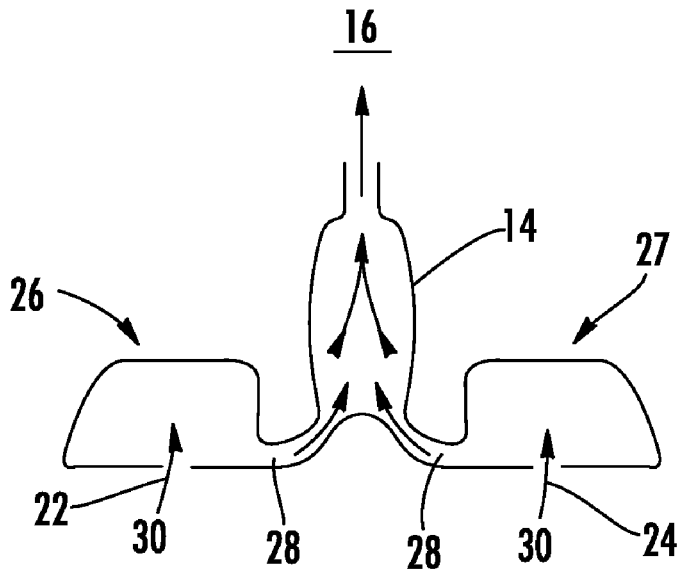
FIG. 3 is a diagram depicting a parallel arrangement of the dispenser of the present invention.
Figure 4:
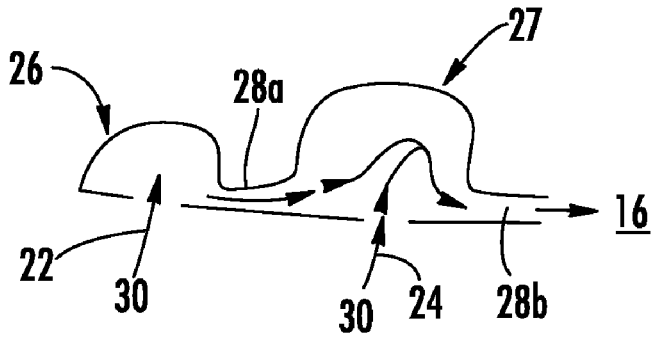
FIG. 4 is a diagram depicting a series arrangement of the dispenser of the present invention.

Turning now to FIGS. 3 and 4, two possible configurations are shown for the arrangement of the first and second metering pumps 26, 27 and the mixing chamber 14. In FIG. 3, the first and second metering pumps 26, 27 are shown as being arranged in parallel relation. The outputs 28 on the first and second metering pumps 26, 27 deposit the first and second fluids 22, 24 directly into the mixing chamber 14 simultaneously where they are mixed and subsequently dispensed. FIG. 4 depicts a series relationship between the first and second metering pumps 26, 27 wherein the first fluid 22 is deposited into the second metering pump 27 via outlet 28*a* and then mixed with a volume of second fluid 24 before dispensing via outlet 28*b*. In this arrangement, the volume of the second metering pump 27 will likely be larger than the volume of the first metering pump 26 so that there is room in the metering chamber of the second metering pump 27 into which to draw a volume of second fluid 24 after the first fluid 22 has been deposited therein.

Figure 5A:
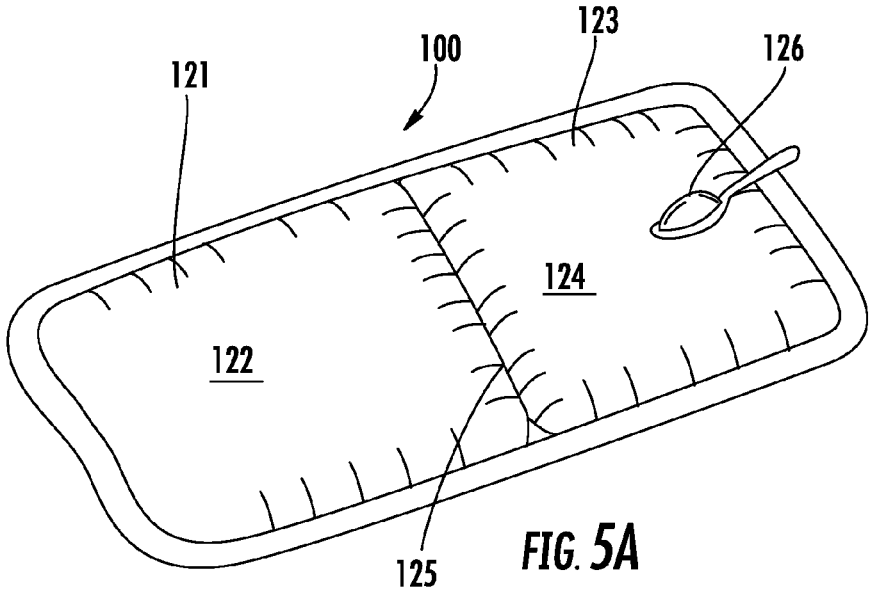
FIGS. 5*a* and 5*b* are a perspective view of an alternate embodiment dual reservoir dispensing device of the present invention.
Figure 5B:
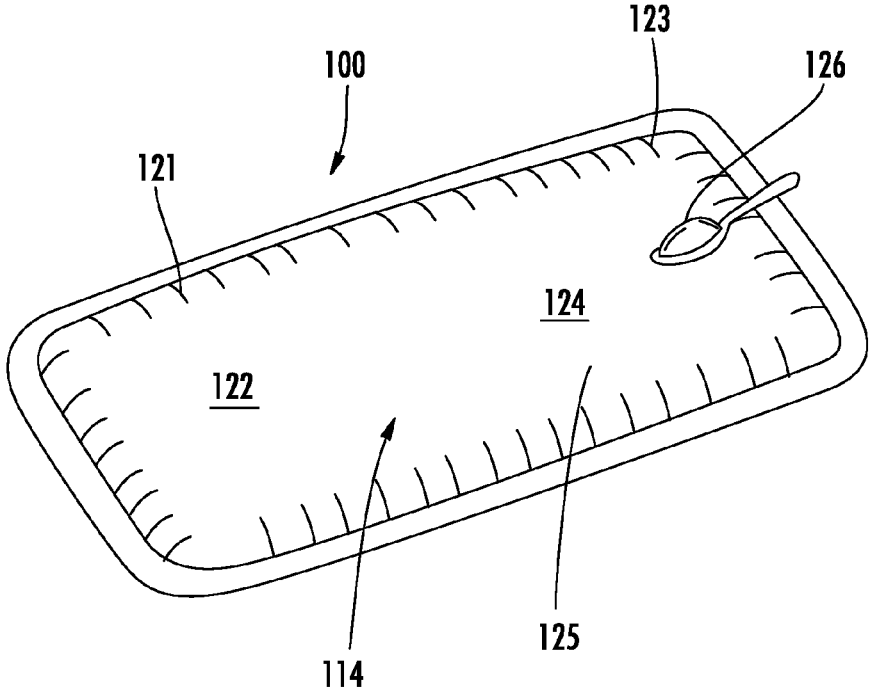

Turning to FIGS. 5*a* and 5*b*, an alternate embodiment of the present invention is shown wherein a device 100 is provided that includes a first fluid reservoir 121 and a second fluid reservoir 123 that are formed within a single pouch having a dividing wall 125 positioned therebetween. The dividing wall 125 is sufficient to maintain the first and second fluids 122, 124 in separate first and second storage reservoirs 121, 123 until sufficient pressure is applied to the pouch rupturing the dividing wall 125, as seen at FIG. 5*b*, allowing the first and second fluids 122, 124 to mix such that the pouch serves as the mixing chamber 114 for the entire volume of first and second fluids 122, 124 contained therein. Then a single metered dosing pump 126 is provided for dispensing the mixed first and second fluids 122, 124. In all respects, the metered dosing pump 126 operates as described above.

Figure 6:
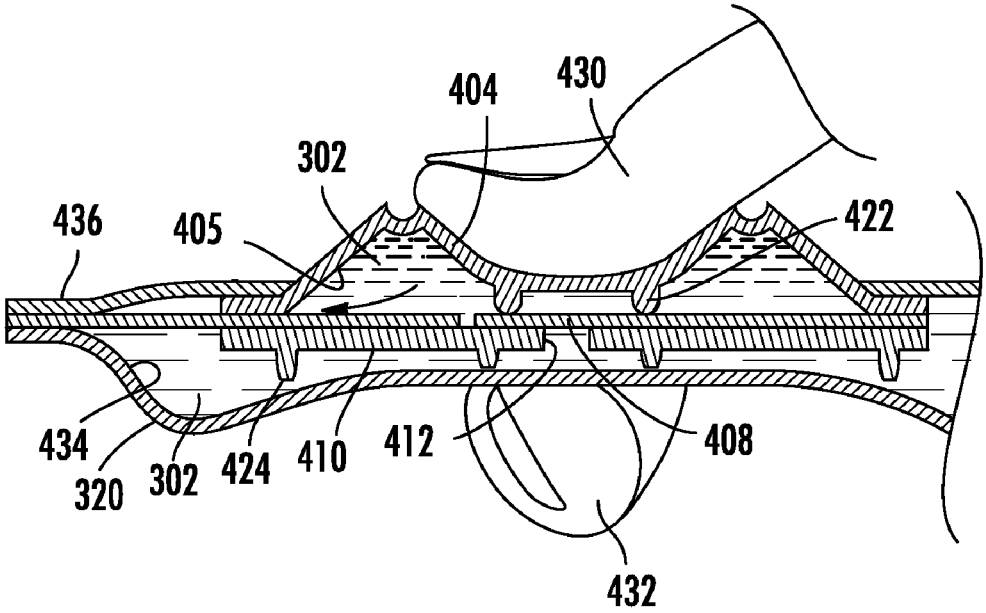
FIG. 6 is a cross sectional view of an alternate embodiment dispensing pump of the invention.

Turning now to FIG. 6, details are shown of an alternate metering pump 300 that includes the improved valving of the present invention that prevents inadvertent or accidental dispensing of fluid 22, 24 even when pressure is placed on the pump 300 or fluid reservoirs 21, 23. In this embodiment of the pump 300 of the present invention, the base plate 410, through which the flow through aperture 412 passes, is preferably slightly convex, although it may be flat, if desired. Resting above the aperture 412 and within the cavity 405 of the dome is a flapper valve 408 of preferably thin film construction. It is possible that this flapper valve 408 be configured of a normally open condition but also may be configured to lie flat when at rest. As long as the plate 410 with the aperture remains convex, the flapper valve 408 does not seal against the aperture 412 such that any inadvertent contact with the flexible dome pump housing 404 does not result in the dispensing of the product. Instead, since the flapper valve 408 is open, liquid product residing inside the cavity 405 of the flexible pump housing 404 will tend to simply flow back through the inlet aperture 412 to the reservoir within the storage container itself, as indicated by the arrow, rather than flow undesirably out through the exit valve to outside of the pump 300. In use, if a person has the fluid dispenser in their pocket or purse and pressure is accidentally or unintentionally placed on the flexible housing 404 of the pump 300, liquid will not flow outside the dispenser thereby preventing a mess from being made due to unintentionally dispensed product.

FIG. 6 illustrates intentional dispensing of fluid 22, 24. When it is desired to actually dispense the liquid product 22, 24, the user's thumb 430 can depress the flexible dome 404 and the user's index finger 432 can invert the base plate 410 from convex to concave, by application of force against the stand-off legs 424, such that flexible dome 404, with the assistance of the stand-off legs 422 under the flexible dome, securely seals and provides a positive lock of the flapper valve 408 over and about the aperture 412 thereby closing the liquid flow passage back into the reservoir 434 of the second fluid reservoir 320. It is also possible that the base plate 410 is concave and then is inverted to a convex configuration. Other fingers of the user may be used to carry out this operation. Thus, the only path for the liquid 302 contained within the cavity 405 of dome 404 is to exit through the one-way outlet valve 436 for intended dispensing of the product, as indicated by the arrows.

Figure 8:
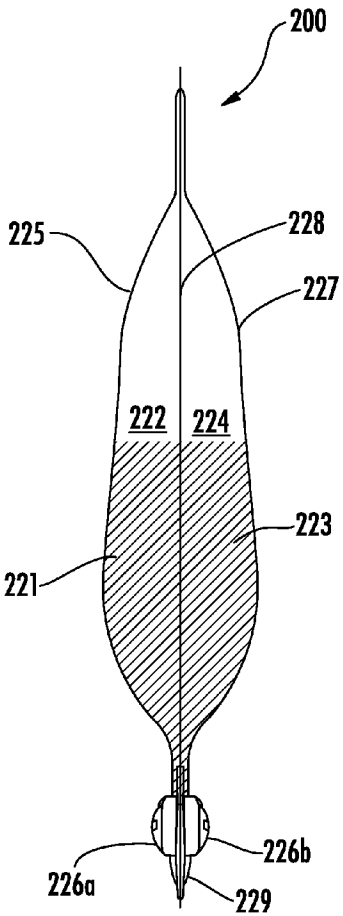
FIG. 8 is a cross sectional view of the dispensing device of FIG. 7 taken along line 8-8.
Figure 7:
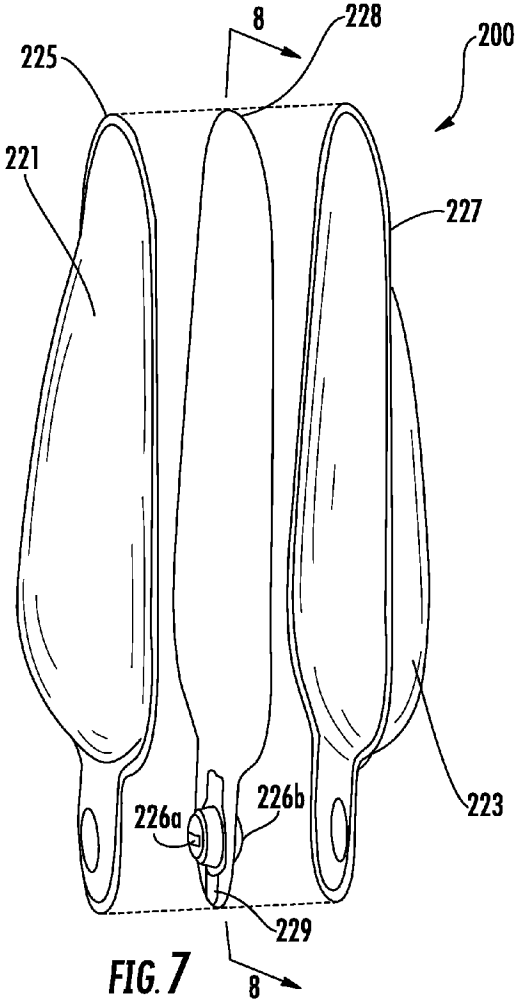
FIG. 7 is an exploded perspective view of a second alternate embodiment dual reservoir dispensing device of the present invention.

Turning to FIGS. 7 and 8, a second alternate embodiment of the present invention is shown wherein a device 200 is provided that includes a first fluid reservoir 221 and a second fluid reservoir 223 that are formed using two outer walls 225, 227 bonded to a dividing wall 228 positioned therebetween. A pair of metered dosing pumps 226*a* and 226*b* can be seen to be arranged in a back-to-back fashion. These metered dosing pumps 226*a* and 226*b* are in clued communication with the first and second fluid reservoirs 221, 223 respectively and are provided for dispensing the first and second fluids 222, 224. The metered dosing pumps 226*a*, 226*b* dispense into a mixing chamber 229 and then dispense the mixture of first and second fluids 222, 224. In all respects, the metered dosing pumps 226*a*, 226*b* operate as described above.

In summary, this invention offers many advantages over the prior art by allowing the user flexibility in maintaining two fluid materials as separate components until just prior to use and application.

It would be appreciated by those skilled in the art that various changes and modifications can be made to the illustrated embodiments without departing from the spirit of the present invention. All such modifications and changes are intended to be covered by the appended claims.

What is claimed is:

1. A fluid dispensing device, comprising:

a first flexible fluid reservoir containing a first fluid, the first flexible reservoir having an interior, an exterior and a first opening therethrough;

a first metered dispensing pump for outputting a measured amount of the first fluid from the first fluid reservoir, the first metered dispensing pump having a flexible dispensing button protruding from the interior to the exterior of the first flexible fluid reservoir through the first opening;

a second flexible fluid reservoir containing a second fluid, the second flexible reservoir having an interior, an exterior and a first opening therethrough;

a second metered dispensing pump for outputting a measured amount of the second fluid from the second fluid reservoir, the second metered dispensing pump having a flexible dispensing button protruding from the interior to the exterior of the second flexible fluid reservoir through the first opening;

a mixing chamber to receive and mix the output of the first and second metered dispensing pumps;

an exit aperture through which mixed first and second fluids are delivered.

2. The fluid dispensing device of claim 1, wherein the first and second metered dispensing pumps have parallel outputs that dispense into the mixing chamber.

3. The fluid dispensing device of claim 1, the first and second metered dispensing pumps each comprising:

a flexible metering chamber within the flexible dispensing button with a predetermined volume, disposed in fluid communication with each pump's respective fluid reservoir;

a first valve disposed between each pump's respective fluid reservoir and the flexible metering chamber to permit unidirectional fluid flow from each pump's respective fluid reservoir into the metering chamber thereby filling the predetermined volume of the metering chamber, the metering chamber further including an output port; and a second valve, having a second valve output port, in fluid communication with the mixing chamber and permitting unidirectional fluid flow of a volume of fluid substantially equal to the predetermined volume of the metering chamber from the metering chamber via the second valve output port.

4. The fluid dispensing device of claim 1, wherein the exit aperture directs the mixed first and second fluid into an applicator.

5. The fluid dispensing device of claim 1, wherein the first and second metered dispensing pumps are positioned adjacent one another such that a user depresses them simultaneously.

6. The fluid dispensing device of claim 1, wherein the first and second fluids are first and second parts of a hair colorant system.

7. The fluid dispensing device of claim 1, wherein the first and second fluids are first and second parts of a hair conditioning system.

8. A fluid dispensing device, comprising:

a first flexible fluid reservoir containing a first fluid;

a first metered dispensing pump for outputting a measured amount of the first fluid from the first flexible fluid reservoir;

a second flexible fluid reservoir containing a second fluid;

a second metered dispensing pump for receiving the first fluid output from the first metered dispensing pump and mixing the first fluid output with a measured amount of second fluid from the second fluid reservoir;

an exit aperture through which mixed first and second fluids are delivered; and wherein the first and second metered dispensing pumps each further comprise:

a flexible metering housing, having a metering chamber therein with a predetermined volume, disposed in fluid communication with the first and second fluid reservoirs;

a first valve disposed between each pump's respective fluid reservoir and the flexible metering housing to permit unidirectional fluid flow from each pump's respective fluid reservoir into the metering chamber thereby filling the predetermined volume of the metering chamber, the flexible metering housing further including a metering housing output port; and a second valve, having a second valve output port permitting unidirectional fluid flow of a volume of fluid substantially equal to the predetermined volume of the metering chamber from the metering chamber via the second valve output port.

9. The fluid dispensing device of claim 8, wherein the first and second metered dispensing pumps are arranged to dispense in a serial fashion.

10. The fluid dispensing device of claim 8, wherein a volume of the second metered dispensing pump is larger than a volume of the first metered dispensing pump.

11. The fluid dispensing device of claim 8, wherein the exit aperture directs the mixed first and second fluid into an applicator.

12. The fluid dispensing device of claim 8, wherein the first and second metered dispensing pumps are positioned adjacent one another such that a user depresses them simultaneously.

13. The fluid dispensing device of claim 8, wherein the first and second fluids are first and second parts of a hair colorant system.

14. The fluid dispensing device of claim 8, wherein the first and second fluids are first and second parts of a hair conditioning system.

15. The fluid dispensing device of claim 8, wherein a volume of the second flexible fluid reservoir is larger than a volume of the first flexible fluid reservoir.

16. A fluid dispensing device, comprising:

a flexible fluid reservoir having an interior, an exterior and a dividing wall forming a first reservoir and a second reservoir, the first reservoir containing a first fluid and the second reservoir containing a second fluid, a first opening in the flexible fluid reservoir;

a metered dispensing pump for outputting a measured amount of fluid from the fluid reservoir, the metered dispensing pump having a flexible dispensing button protruding from the interior to the exterior of the first fluid reservoir through the first opening; and wherein the dividing wall is configured to rupture upon applying sufficient pressure to the flexible reservoir allowing the first and second fluid to mix within the flexible fluid reservoir.

17. The fluid dispensing device of claim 16, wherein a volume of the second reservoir is larger than a volume of the first reservoir.

18. The fluid dispensing device of claim 16, wherein the output of the metered dispensing pump is directed into an applicator.

19. The fluid dispensing device of claim 16, the metered dispensing pump comprising:

a flexible metering housing, having a metering chamber therein with a predetermined volume, disposed in fluid communication with the flexible fluid reservoir;

a first valve disposed between the flexible fluid reservoir and the flexible metering housing to permit unidirectional fluid flow from the flexible fluid reservoir into the metering chamber thereby filling the predetermined volume of the metering chamber, the flexible metering housing further including a metering housing output port; and a second valve, having a second valve output port permitting unidirectional fluid flow of a volume of fluid substantially equal to the predetermined volume of the metering chamber from the metering chamber via the second valve output port.

* * * * *